US005507602A

United States Patent [19]

Walker

[11] Patent Number: 5,507,602

[45] Date of Patent: Apr. 16, 1996

[54] POWDER TRANSFER FROM SUPERSACK CONTAINERS AND DISPERSION INTO A HOMOGENEOUS SLURRY

[75] Inventor: Richard C. Walker, Bel Air, Md.

[73] Assignee: J. M. Huber Corporation, Edison, N.J.

[21] Appl. No.: 322,497

[22] Filed: Oct. 14, 1994

[51] Int. Cl.[6] ..... B65G 53/26; B65G 53/38

[52] U.S. Cl. ..... 406/122; 406/39; 406/134; 406/151; 406/154; 222/195

[58] Field of Search ..... 406/39, 108, 122, 406/134, 136, 137, 145, 151, 152, 153, 154; 222/181.2, 195

[56] References Cited

U.S. PATENT DOCUMENTS

| | | | |
|---|---|---|---|
| 4,007,921 | 2/1977 | Zingg | 366/10 |
| 4,778,280 | 10/1988 | Brazelton | 366/136 |
| 4,902,173 | 2/1990 | Hendee et al. | 406/145 |
| 4,955,723 | 9/1990 | Schneider | 366/136 |
| 5,161,887 | 11/1992 | Goldberg et al. | 366/139 |

FOREIGN PATENT DOCUMENTS

| | | | |
|---|---|---|---|
| 4219616 | 12/1993 | Germany | 406/151 |
| 2240969 | 8/1991 | United Kingdom | 406/108 |

*Primary Examiner*—Andrew C. Pike

*Attorney, Agent, or Firm*—Lowe, Price, LeBlanc & Becker

[57] ABSTRACT

Apparatus with a horizontally stretched flexible membrane is used to sealingly support a lower, openable end portion of an air-permeable sack containing powder material. A conical funnel-like sealable portion of the apparatus immediately beneath the membrane may be connected to a mechanism for applying a suction. This suction uses inward air flow from the ambient atmosphere through the air-permeable wall of the sack and the powder material contained therein, to generate a fluidized air/powder material outflow from the lower opening of the sack. The funnel-like element guides this flow and enables transfer of the air-fluidized powder material flow. To form a slurry, a conventional disperser/mixer mechanism dipped into a quantity of liquid in a tank may be connected to a suction duct to apply the desired suction. Fluidized air/powder material flow then is intensely and rapidly stirred with the liquid to form a slurry.

14 Claims, 2 Drawing Sheets

POWDER TRANSFER FROM SUPERSACK CONTAINERS AND DISPERSION INTO A HOMOGENEOUS SLURRY

FIELD OF THE INVENTION

This invention relates to an apparatus and a method for transferring a powder material from a large sack-type container for subsequent formation of a slurry therefrom, and more particularly to apparatus and a method for supporting what are known as "supersack" containers of powder material in a way that eliminates dust and atmospheric contamination and facilitates quick and even mixing of powder material flowed out of the supersack and into a liquid to form a slurry.

BACKGROUND OF THE RELATED ART

There are many circumstances in which materials in the form of a fine powder are conveniently stored and transported in sacks. Relatively large quantities of powder material are frequently contained in what are commonly known in the industry as "supersacks" which are typically made of a strong tightly-woven fabric and are provided with an end opening closeable by a drawstring. Such a supersack may have loops, rings, or other elements attached conveniently at an end opposite to the openable end for suspension, hooking, or other conventional attachment of the sack with the opening disposed to discharge the contents downwardly.

The fabric of the supersack being finely woven has the quality that the powder material contained therein cannot leak out in normal handling of the sack. However, molecules of gases contained in the ambient atmosphere, being much smaller than the average size of a particle of the powder material, can leak into the sack as powder material is extracted from within. This ensures against undesirable particulate pollution of the ambient atmosphere in routine handling of a closed sack. However, when the sack is opened to extract powder material therefrom, there is always a substantial likelihood that some of the powder material will escape into the atmosphere. One solution is to enclose the sack, and particularly the opening from which the part of the material flows, to minimize such pollution. Augers are often used to promote the outflow of powder material between containers or from a container to apparatus for forming a slurry.

U.S. Pat. No. 5,161,887, to Goldberg et al., titled "Process for Producing an Aqueous Solution of Difficult-to-dissolve, Fine Particle Size Particulate Material", teaches a system in which a fine particulate material is contained in a large sealed bag which includes a tube that unfolds and extends from beneath a lower portion of the sack. This tube fits into a hopper adapter and a cord is thereafter untied to allow the particulate material to flow outward. This outflow is controlled and assisted by an auger feeder, which delivers it into a mixing vessel where it is mixed with a stream of water. A partial vacuum is applied to the mixed flow which is passed through a high speed mixing pump to obtain the desired solution.

U.S. Pat. No. 4,955,723, to Schneider, titled "Slurry Mixing Apparatus with Dry Powder Conveyer", teaches a system in which a vacuum generated by a vacuum pump is applied to a flexible conduit dipped into an open sack of powdered material to entrain the material with air sucked via the conduit. The sucked-up material is directed to fall onto an upper surface of a quantity of liquid contained and stirred in a closed tank to cause mixing thereof to form a slurry.

U.S. Pat. No. 4,778,280, to Brazelton, titled "Mixing Apparatus", teaches an apparatus in which dry particulate material is fed through a funnel into a casing which receives water circumferentially so as to create a swirl.

U.S. Pat. No. 4,007,921, to Zingg, titled "Apparatus for Mixing Dry Particles with a Liquid", teaches an apparatus in which dry cement particles fall downward through a hopper, past a regulating valve into a mixing compartment to be mixed with a water flow. The resulting mixture is flowed into a rotating impeller which recirculates a portion of the resultant slurry. Thus, as some slurry is drawn away from the system, the rest recirculates and is intensely mixed with an added supply of water mixed with cement particles.

The above-discussed exemplary prior art requires relatively complex apparatus which is expensive to install and maintain, does not ensure against particulate air pollution, and can experience problems related to clogging of the particulate outflow from the original container or sack.

Accordingly, there is a perceived need for apparatus and a method for transferring powder material from a conventional large sack and for efficiently mixing it at a controlled rate into a liquid to form a slurry while ensuring against atmospheric pollution due to leakage of the powder material into the atmosphere. The present invention, as described and claimed below, is intended to provide a simple, efficient, and affordable solution to this need.

SUMMARY OF THE INVENTION

It is a principal object of this invention to provide apparatus for transferring quantities of a powder material from a sack containing the same for further transfer thereof under suction while eliminating leakage into the ambient atmosphere.

A related object of this invention is to provide apparatus for extracting powder material from a large sack containing the same, and for transferring the powder material in a fluidized particle-air flow for efficient and intense mixing of the powder material into a liquid to form a slurry.

It is a related further object of this invention to provide apparatus for extracting at a controlled rate a flow of fine particulate matter from a sealingly supported sack thereof, by the application of a vacuum generated by a disperser/mixer mechanism, for producing a slurry from the powder material mixed with a liquid while preventing leakage of the powder material into the ambient atmosphere.

In another aspect of this invention, there is provided a method for extracting a powder material from a sack-like container, supported at an opened lower end around an opening thereof, by applying a suction at the opening.

It is a related further aspect of this invention to provide a method for extracting a flow of air-fluidized powder material from an air-permeable sack containing the same, by applying a suction to an opening of the sack and conveying the air-fluidized flow of powder material under the applied suction to a quantity of liquid wherein the part of the powder material is quickly and thoroughly mixed to provide a slurry.

These and other related objects of this invention are realized by providing an apparatus for transferring a powder material from an air-permeable sack, the apparatus including an unloader means which provides sealing and support around an opening at a lower of the air-permeable sack. Means are also provided for applying a suction to the opening to generate air flow of ambient air via an air-permeable wall of the sack and the powder material contained therein, to fluidize the powder material and thereby facilitate a downward flow thereof through the opening.

In another aspect of this invention, there is provided a method for transferring a powder material from a sack containing the same and for mixing the transferred powder material into a slurry, the method including the steps of sealingly supporting an air-permeable sack containing a powder material around a lower opening of the sack, and applying the suction to the sack opening to generate the flow of ambient air via an air-permeable wall of the sack and powder material contained in the sack to fluidize the powder material and facilitate downward flow thereof through the opening.

DETAILED DESCRIPTION OF THE PREFERRED EMBODIMENTS

Figure 1:
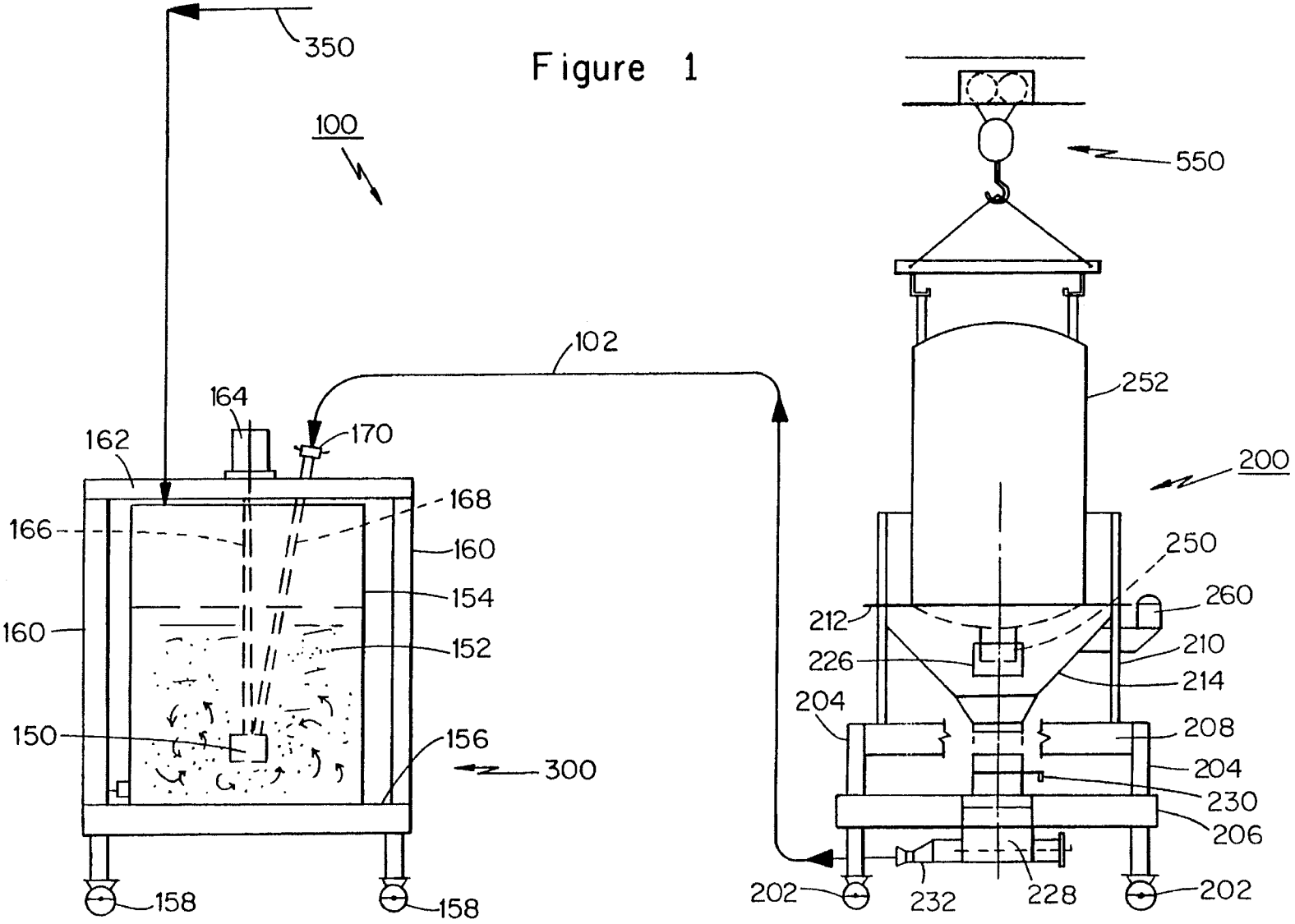
FIG. 1 is a schematic partial cross-sectional view of principal elements of a preferred embodiment of this invention, which includes a view of a "supersack" unloader and a cooperating disperser/mixer.
Figure 2:
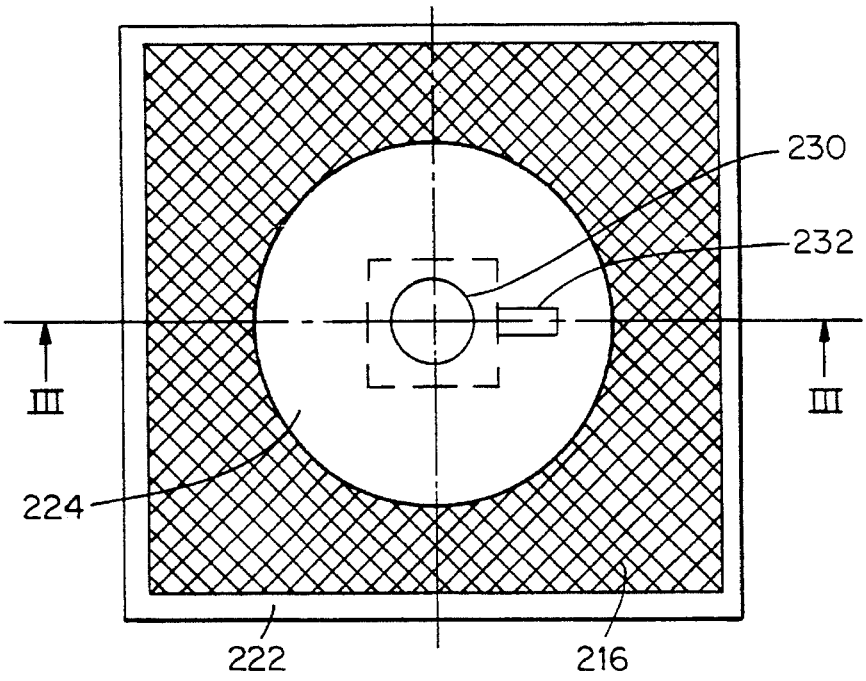
FIG. 2 is a partial plan view of an upper portion of a supersack and an loader according to the preferred embodiment per FIG. 1.

As best seen in FIG. 1, the apparatus 100 according to the preferred embodiment includes both a supersack unloader 200 and a conventional disperser/mixer unit 300 connected thereto by a duct 102 by which a suction may be applied therebetween.

Supersack unloader 200 is preferably mounted on a set of wheels or casters 202,202 which support respective corner upright elements 204, 204 which are, in turn, attached to a horizontal support platform 206. To the upper end portions of uprights 204, 204 is attached a second horizontal platform 208 which supports upright members 210, 210 which end in a horizontal first flange 212 at the periphery of a funnel-like element 214.

Figure 3:
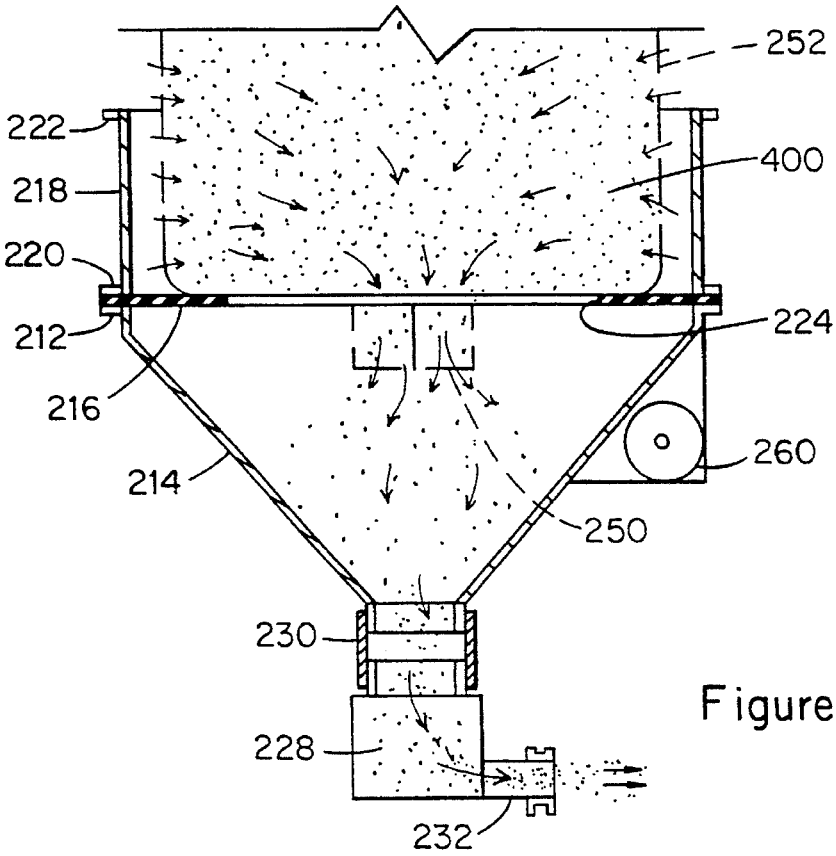
FIG. 3 is a partial vertical, axial, cross-sectional view taken along line III—III in FIG. 2 of a lower portion of a supersack sealingly supported by a horizontal, peripherally supported membrane which sealingly supports a lower end of the supersack around the powder material delivery opening thereof.

As best seen in FIG. 3, directly above first flange 212 is provided a flexible, strong, somewhat elastic, horizontally disposed membrane 216. Membrane 216 may be made of neoprene or any other durable, conformable, material. An outer peripheral portion of membrane of 216 lies directly over and in contact with an upper surface of first flange 212. Directly above an upper peripheral surface of membrane 216 is mounted an open, upright, peripheral wall element 218 which has a lower flange 220 generally matching in shape and size the first flange 212. To the top of upright wall element 218 may be provided a second upper flange 222 to strengthen and stiffen the upper periphery thereof.

As best seen in FIG. 3, the outmost peripheral portion of the membrane 216 is thus firmly sandwiched, partly by the weight of flanged element 218 and partly by conventional fastening means such as clamps, nuts-and-bolts, or the like (not shown). The goal is to ensure that the periphery of membrane 216 is very firmly held at all times while the body of membrane 216 is stretched horizontally when not loaded. At the center of membrane 216 there is provided an aperture 224 which is shaped and sized to comfortably accommodate therethrough an opening structure 250 of a supersack 252, as shown in broken and chain lines in FIG. 3.

The goal of the just-described structural configuration is to ensure that a bottom portion of supersack 252 rests on and is supported by firm and intimate contact with an upper surface of membrane 216 in an annular region surrounding aperture 224. FIG. 3 shows supersack 252 in an idealized shape. In practice, as indicated by broken lines in FIG. 1, the flexibility and powder material contents of supersack 252 will cause the bottom portion thereof to be rounded, and flexible membrane 216 will take on a shape to match and closely fit to and support it.

The funnel-shaped element 214 is provided with a sealingly closable hatch 226, as best seen in FIG. 1. By opening this hatch, an operator can easily reach the opening portion 250 of supersack 252 to open it to permit downward flow of powder material from sack 252. Such a downflow will be sealed in within the space defined by the bottom surface of membrane 216, the inside conical surface of element 214 and the central lower surface of supersack 252 resting on and supported by membrane 216. With the hatch 226 closed thereafter, this region remains closed and prevents any leakage of powder material from supersack 252 even when a suction is not being applied. The powder material falling downwardly to the conically narrowing bottom portion of element 214 passes through an upper opening of duct-connector 228. A flexible sleeve and an optional sleeve-valve 230 may be included to positively seal off the conical space beneath the opening portion 250. Duct-connector 228 is conveniently provided with a short horizontal connection stub-232 provided with conventional fitting means for fitting to and communicating with duct 102 (shown as a line with arrows to indicate suction-induced flow in FIG. 1).

With the apparatus described above, application of suction to duct 102 will create a sub-atmospheric pressure within the funnel-shaped space between the bottom of supersack 252 and membrane 216 and the inside conical surface of element 214. If the bottom opening portion 250 of supersack 252 has already been opened, as described above, the suction will be transmitted through the interstices between adjacent particles of the powder material 400. The air-permeability of the material of which supersack 252 is formed will then permit the ingress of air molecules from the ambient atmosphere, as generally indicated by short arrows in FIG. 3, so that an inflow of air percolates through, loosens, and thereby fluidizes the powder material 400 into an easy but controlled outflow. Thus, not only is leakage of powder material out of the supersack 252 prevented during unloading thereof but, equally important, the inflow of ambient air is utilized to loosen and promote outflow of the powder material under suction applied to duct connector stub 232 through duct 102.

As is common in handling powder materials, a conventional vibrator mechanism 260 may advantageously be attached at a convenient location on the unloader structure. Such a mechanism promotes further loosening of the powder material inside supersack 252, facilitates inflow of ambient air under suction through the walls of supersack 252, and generally promotes the operation of unloader 200 in use. Note that vibrator mechanism 260 is shown in two optional dispositions in FIGS. 1 and 3, respectively. Depending on which one of many commercially available vibrator mechanisms is chosen, one or the other disposition may be most advantageous in use.

As shown in FIG. 1, once the powder material flow is initiated under suction applied by duct 102, in order to form a slurry with the transferred powder material there is provided a disperser/mixer mechanism 150. It is located inside a quantity of a liquid 152, e.g., water contained within a tank 154 supported on a wheeled platform 156 mounted on a plurality of wheels or casters 158,158. Platform 156 supports a framework 160 to which is mounted an upper horizontal mounting plate 162. Mounting plate 162 supports an electric drive motor 164 and a downwardly depending connection tube 166 linking the drive motor 164 to the disperser/mixer mechanism 150.

As best seen in FIG. 1, to an outer casing of disperser/mixer 150 is connected a length of tubing 168 ending in a conventional connector 170 for connecting to a suction-applying end of duct 102. The disperser/mixer mechanism and ancillary drive, etc. may be of any conventional and commercially available type, e.g., a "Quadro-Y Tron" model. Such a disperser/mixer mechanism typically has a rotating, multibladed impeller element which is rotated by drive motor 164 and which generates a suction at a location of its casing. By connecting this portion of the casing of the disperser/mixer mechanism 150 to duct 102 the needed suction is readily applied thereto. This draws in air, as described above, through the air-permeable wall of supersack 252, thereby fluidizing the powder material 400 contained in the supersack, to obtain a fluidized air/powder material flow through duct 102 to the inside of the casing of the disperser/mixer 150. The sucked air and powder material are expelled in a swirling rotational manner by disperser/mixer 150 into liquid 152, with the result that there is violent agitation and mixing to cause thorough wetting of the powder material and the quick and highly efficient formation of a slurry. This is indicated generally by curving arrows and dots representing particles swirling to form the slurry from liquid 152 by the addition thereto of powder material through duct 102. See FIG. 1.

For convenience, a water-line 350 may be utilized to provide water flow into tank 154 if the slurry is to be made with water. Similarly, a polymer, an oil, an emulsion, or other generally liquid-type material may be provided by and through line 350 as needed.

In practice, when the supersack unloader 200 is connected to and utilized with the disperser/mixer assembly 300, as described above, a supersack 252 is carried by a conventional overhead crane mechanism 550 and is slowly lowered until its lowest portion is resting on and sealingly supported by the upper surface of membrane 216. It is not necessary that membrane 216 should support the entire weight of a filled supersack, and the operator may obtain the desired sealing support for the lowermost portion of supersack 252 by controlled lowering thereof by manipulation of controls for the crane 550.

The operator utilizes hatch 226 to reach in and open the drawstring in the opening portion 250 of supersack 252, and then closes the hatch 226 to ensure proper sealing against leakage of powder material 400 to the ambient atmosphere. A suitable quantity of the desired liquid is obtained through line 350 into tank 154. The disperser/mixer motor 164 is then turned on and the resulting vacuum generated by disperser/mixer mechanism 150 is communicated via line 102 to draw air in and through the powder material contained in sack 252. The air-fluidized flow of powder material 400 is then conveyed through duct connector 228, duct 102, and tube 168 to the rotating element of disperser/mixer 150. This sucked-in powder material is then forcibly and rapidly mixed with liquid 152 and, within minutes, the desired slurry should be obtained.

The achievement of this state of affairs may be determined by any conventional means, e.g., by determining the weight, before and after the slurry-mixing operation, of the disperser/mixer assembly 300. In the alternative, a suitable amount of liquid to obtain the desired slurry composition may be provided in tank 154 from the start and the entire contents of a supersack 252 mixed therewith. Other options will no doubt occur to persons of ordinary skill in the art. Once the slurry is formed, motor 164 may be turned off, and duct 102 disconnected from setting 170. The entire disperser/mixer assembly 300 may be then wheeled away to deliver the slurry to its intended location of use. Any conventional means for pumping slurry may then be connected to tank 154 to empty the contents thereof.

In this disclosure, there are shown and described only the preferred embodiments of the invention, but, as aforementioned, it is to be understood that the invention is capable of use in various other combinations and environments and is capable of changes or modifications within the scope of the inventive concept as expressed herein.

What is claimed is:

1. An apparatus for transferring a powder material from an air-permeable sack, the apparatus comprising:

unloader means for providing sealing and support around an opening at a lower end of the air-permeable sack; and means for applying a suction to the opening to generate a flow of ambient air via an air-permeable wall of the sack and the powder material contained therein to fluidize the powder material and thereby facilitate a downward flow thereof via the opening.

2. The apparatus according to claim 1, wherein:

the unloader means comprises a flexible membrane which is supported at an outer periphery and is formed with an aperture shaped, sized, and located to closely surround the opening of the sack and to provide support to a lower portion of the sack wall around the opening.

3. The apparatus according to claim 2, wherein:

the unloader means comprises a funnel-like portion positioned below the aperture of the membrane to facilitate application of the suction to the sack opening and to guide the resulting flow of fluidized powder material from the sack opening to a duct connection means for connecting the unloader means to a duct to further transfer the powder material.

4. The apparatus according to claim 3, further comprising:

disperser/mixer means for generating the suction communicated via the duct to the duct connection means, to provide the suction thereto and to facilitate further transfer of the fluidized powder material flow and simultaneously dispense and mix transferred powder material into a quantity of a liquid to form a slurry.

5. The apparatus according to claim 4, further comprising:

a tank for holding the liquid and the disperser/mixer means for forming the slurry.

6. The apparatus according to claim 1, wherein:

the unloader means comprises a funnel-like portion to facilitate application of the suction to the sack opening and to guide the resulting flow of fluidized powder material from the sack opening to a duct connection means for connecting the unloader means to a duct to further transfer the powder material.

7. The apparatus according to claim 1, further comprising:

vibrator means for applying a vibratory input to the powder material contained in the sack to facilitate the flow thereof via the opening.

8. A method of transferring a powder material from an air-permeable sack, comprising the steps of:

sealingly supporting the air-permeable sack containing the powder material around a lower opening of the sack; and applying a suction to the sack opening to generate a flow of ambient air via an air-permeable wall of the sack and the powder material contained in the sack to fluidize the powder material and facilitate downward flow thereof through the opening.

9. The method according to claim 8, comprising the further step of:

supporting a flexible membrane around a periphery thereof and providing an aperture in the membrane shaped, sized, and located to closely surround the sack opening and to sealingly support a portion of the sack air-permeable wall around the opening.

10. The method according to claim 9, comprising the further step of:

guiding the flow of fluidized powder material through a funnel-like element below the opening from the sack to a duct connection means and through a duct for further transfer of the fluidized powder material.

11. The method according to claim 8, comprising the further step of:

guiding the flow of fluidized powder material through a funnel-like element below the opening from the sack to a duct connection means and through a duct for further transfer of the fluidized powder material.

12. The method according to claim 11, comprising the further step of:

operating a disperser/mixer means to generate the suction communicated via the duct to the duct connection means to facilitate further transfer of the fluidized powder material flow from the sack and to simultaneously disperse and mix transferred powder material within a liquid to form a slurry.

13. The method according to claim 12, comprising the further step of:

providing a tank for holding the liquid and the disperser/mixer means to form and hold the slurry formed thereby.

14. The method according to claim 8, comprising the further step of:

applying a vibratory input to the powder material contained in the sack to facilitate the flow thereof via the opening.

* * * * *